US007269968B2

(12) United States Patent
Harder et al.

(10) Patent No.: US 7,269,968 B2
(45) Date of Patent: Sep. 18, 2007

(54) CHILLED WATER DISPENSING ARRANGEMENT FOR A REFRIGERATOR

(75) Inventors: Jonathan D Harder, Greenville, OH (US); Eric W Klein, Anna, OH (US); Gary L Gaither, Tipp City, OH (US)

(73) Assignee: Norcold, Inc., Sidney, OH (US)

( * ) Notice: Subject to any disclaimer, the term of this patent is extended or adjusted under 35 U.S.C. 154(b) by 137 days.

(21) Appl. No.: 11/062,208

(22) Filed: Feb. 21, 2005

(65) Prior Publication Data

US 2005/0198991 A1 Sep. 15, 2005

Related U.S. Application Data

(60) Provisional application No. 60/552,451, filed on Mar. 11, 2004.

(51) Int. Cl.
*B67D 5/62* (2006.01)

(52) U.S. Cl. ..... 62/389; 62/338; 222/146.6

(58) Field of Classification Search ..... 62/338–339, 62/389–400, 441–447; 22/146.6
See application file for complete search history.

(56) References Cited

U.S. PATENT DOCUMENTS 2,400,135 A * 5/1946 Quinn ..... 62/274
3,429,140 A 2/1969 White
3,511,415 A 5/1970 Crowe
3,908,394 A 9/1975 Jacobus
4,036,620 A 7/1977 Benasutti et al.
4,543,800 A 10/1985 Mawby et al.
4,739,629 A * 4/1988 True ..... 62/338
4,912,942 A 4/1990 Katterhenry et al.
5,263,509 A 11/1993 Cherry et al.
5,542,264 A * 8/1996 Hortin et al. ..... 62/338
5,787,724 A 8/1998 Pohl et al.
5,813,246 A 9/1998 Oh
5,819,547 A 10/1998 Oh
5,855,120 A 1/1999 Kim
5,862,952 A 1/1999 Lee
5,941,619 A 8/1999 Stieben et al.
5,971,213 A 10/1999 Lee
6,041,607 A 3/2000 Kim
6,079,221 A 6/2000 Senner
6,425,425 B2 7/2002 Bianchi et al.
6,574,984 B1 6/2003 McCrea et al.
6,622,509 B2 9/2003 Stich et al.
2003/0019236 A1 1/2003 Heims et al.

* cited by examiner

*Primary Examiner*—William E. Tapolcai
(74) *Attorney, Agent, or Firm*—Harness, Dickey & Pierce, P.L.C.

(57) ABSTRACT

A refrigerator has a cabinet, at least one door and a chilled water dispenser. The at least one door is mounted to the cabinet for movement between a closed position and an open position. The chilled water dispenser includes a nozzle extending from the cabinet. The dispenser is associated with the door and is accessible when the door is in its closed position.

15 Claims, 8 Drawing Sheets

CHILLED WATER DISPENSING ARRANGEMENT FOR A REFRIGERATOR

FIELD OF THE INVENTION

The present invention relates to refrigeration systems. More particularly, the present invention relates to a chilled water dispensing arrangement for a refrigerator. More specifically, but without restriction to the particular embodiment and/or use which is shown and described for purposes of illustration, the present invention pertains to a refrigerator for a vehicle having a chilled water dispensing arrangement.

BACKGROUND OF THE INVENTION

Vehicles including recreational vehicles (commonly referred to in Europe as "caravans"), airplanes, boats, trains, and the like often include refrigerators for the convenience of the passengers. The refrigerators of vehicles must perform under operating conditions that are significantly different from non-transitory refrigerators conventionally found in homes and businesses ("home refrigerators"). For example, vehicle refrigerators are typically located in relatively confined areas and must even further maximize the use of space. Additionally, water available on a motor vehicle is generally from on on-board water source typically with a temperature significantly higher compared to water available for home use. Furthermore, motor vehicle refrigerators need to be able to be winterized (e.g., drained of fluids)—a requirement that is not necessary for typical home refrigerators.

The design of vehicle refrigerators must accommodate distinct operating conditions, some of which are discussed above. Vehicle refrigerators also preferably provide the user with the comforts and customary features associated with home refrigerators.

SUMMARY OF THE INVENTION

In one aspect, the present teachings provides a refrigerator having a cabinet, at least one door and a chilled water dispenser. The at least one door is mounted to the cabinet for movement between a closed position and an open position. The chilled water dispenser includes a nozzle extending from the cabinet. The dispenser is associated with the door and is accessible when the door is in its closed position.

The present teachings also provide a water reservoir for a refrigerator having a water dispensing nozzle. The water reservoir includes a plurality of legs, wherein each leg is oriented at an angle relative to the vertical, a water inlet adjacent a lower end of the reservoir, and a water outlet adjacent an upper end of the reservoir.

The present teachings further provide a method of draining a refrigerator having a chilled water dispenser of water for winterization or sanitation. The method includes providing the refrigerator with a serpentine water reservoir having an upper end connected to a dispensing nozzle and a lower end connected to a water source, removing the water source, and allowing water to drain from the serpentine reservoir completely under the force of gravity.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE VARIOUS EMBODIMENTS

The following description of various embodiments of the present invention is merely exemplary in nature and is in no way intended to limit the invention, its application, or uses.

Figure 1:
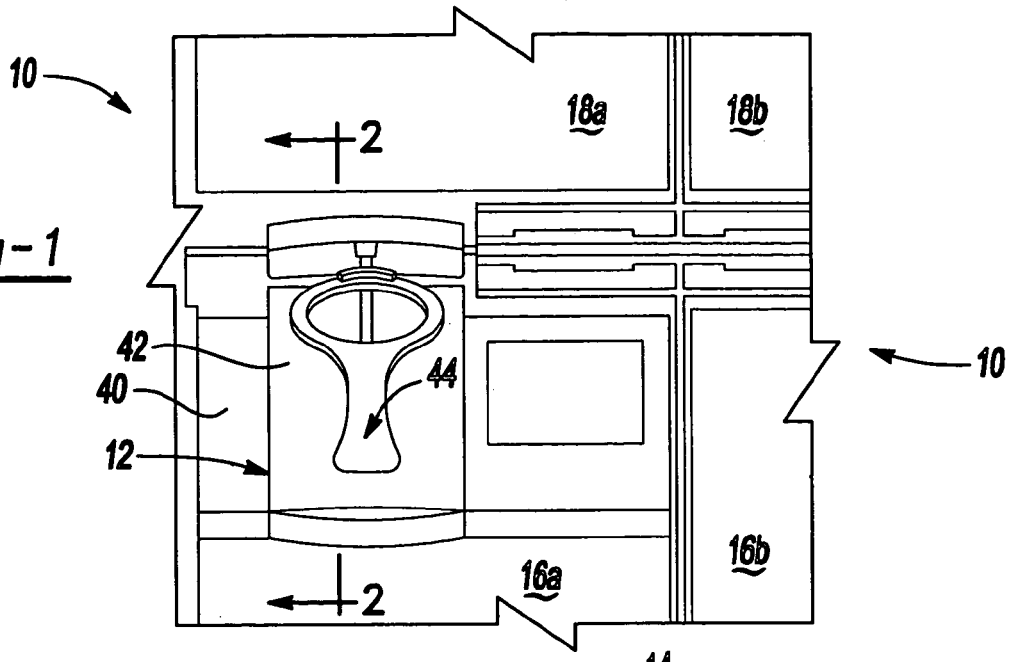
FIG. 1 is a front view of a refrigerator including a chilled water dispensing arrangement constructed in accordance with the teachings of the present invention.

With initial reference to FIG. 1 of the drawings, a refrigerator 10 constructed to include a chilled water dispensing arrangement 12 according to the teachings of the present invention is illustrated. In one particular application, the refrigerator 10 is intended for use within a motor vehicle such as a recreational vehicle, boat, or the like. After a reading of the remainder of this detailed description, however, those skilled in the art will readily appreciate that the teachings of the present invention are not limited to this exemplary application. Rather, various of the teachings of the present invention have applicability to other vehicle and non-vehicle applications.

Figure 2:
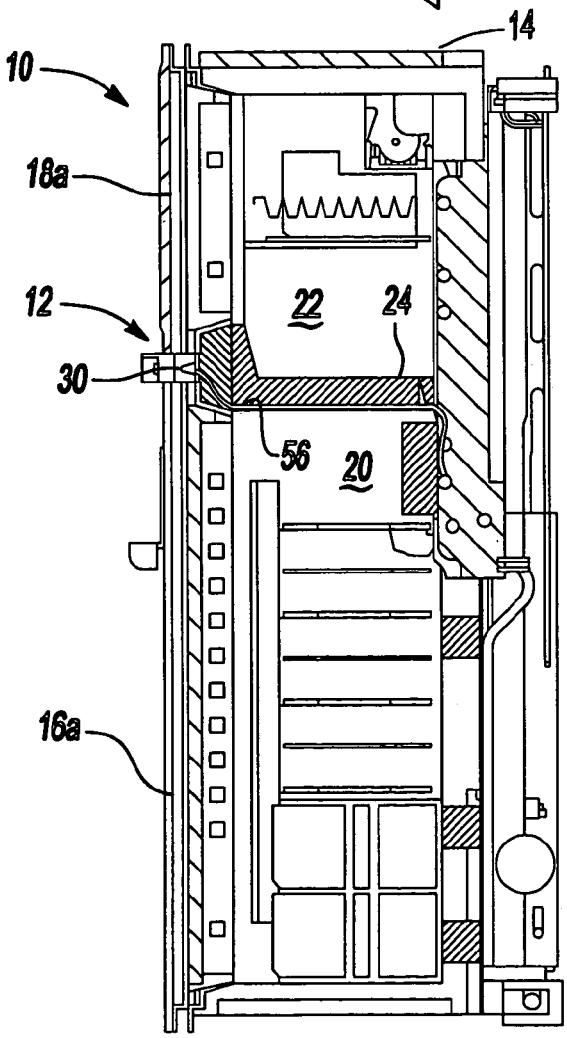
FIG. 2 is a cross-sectional view taken along the line 2-2 of FIG. 1.

Prior to addressing the chilled water dispensing arrangement 12 of the present invention, a brief description of the exemplary environment shown throughout the drawings is warranted. This brief description will be had with continued reference to FIGS. 1 and additional reference to the cross-sectional view of FIG. 2. The refrigerator 10 is illustrated to include at least two doors that are mounted to a cabinet 14 for conventional movement between open and closed positions. More particularly, the refrigerator 10 is illustrated to include a pair of lower doors 16*a* and 16*b* and a pair of upper doors 18*a* and 18*b*. The pair of lower doors 16*a* and 16*b* cooperate with the cabinet 14 to define a refrigerator compartment 20. The upper pair of doors 18*a* and 18*b* cooperate to define a freezer compartment 22. The refrigerator compartment 20 and the freezer compartment 22 are separated by a divider or mullion 24, which is horizontally oriented in the embodiment illustrated in FIG. 2, although vertical mullions can also be used. In the environment illustrated, the chilled water dispensing arrangement 12 is shown particularly associated with the left hand doors 16*a* and 18*a* of the refrigerator 10, and is accessible for dispensing when the doors 16*a* and 18*a* are in their closed position.

With general reference to all of the drawings, FIGS. 1-11, the chilled water dispensing arrangement 12 of the present invention will be further described. The chilled water dispensing arrangement 12 will be understood to generally include a water dispensing portion 26 and a water reservoir 28 for providing a source of chilled water to the water dispensing portion 26. As perhaps most particularly shown in FIGS. 2 and 5, the water dispensing portion 26 includes a nozzle 30 extending from the refrigerator 10. The nozzle 30 may extend from the mullion 24. Significantly, the nozzle 30 is a static nozzle which is not mounted for movement with any of the doors of the refrigerator 10. The nozzle 30 is shown carried on a mounting plate 32 which is secured to the cabinet 14 by one or more fasteners 34. A distal end 36 of the nozzle 30 is downwardly directed for delivering the chilled water directly to a water glass or other container. The mounting bracket 32 carries additional components such as a light and a nozzle actuator which will be understood to be conventional in both construction and operation insofar as the present invention is concerned.

The water dispensing portion 26 is further illustrated to include a cover 38 for concealing the nozzle 30 and mounting bracket 32. The cover 38 is secured to the mullion 24 with fasteners (not particularly shown) or alternatively secured in any other manner well known in the art.

Figure 3:
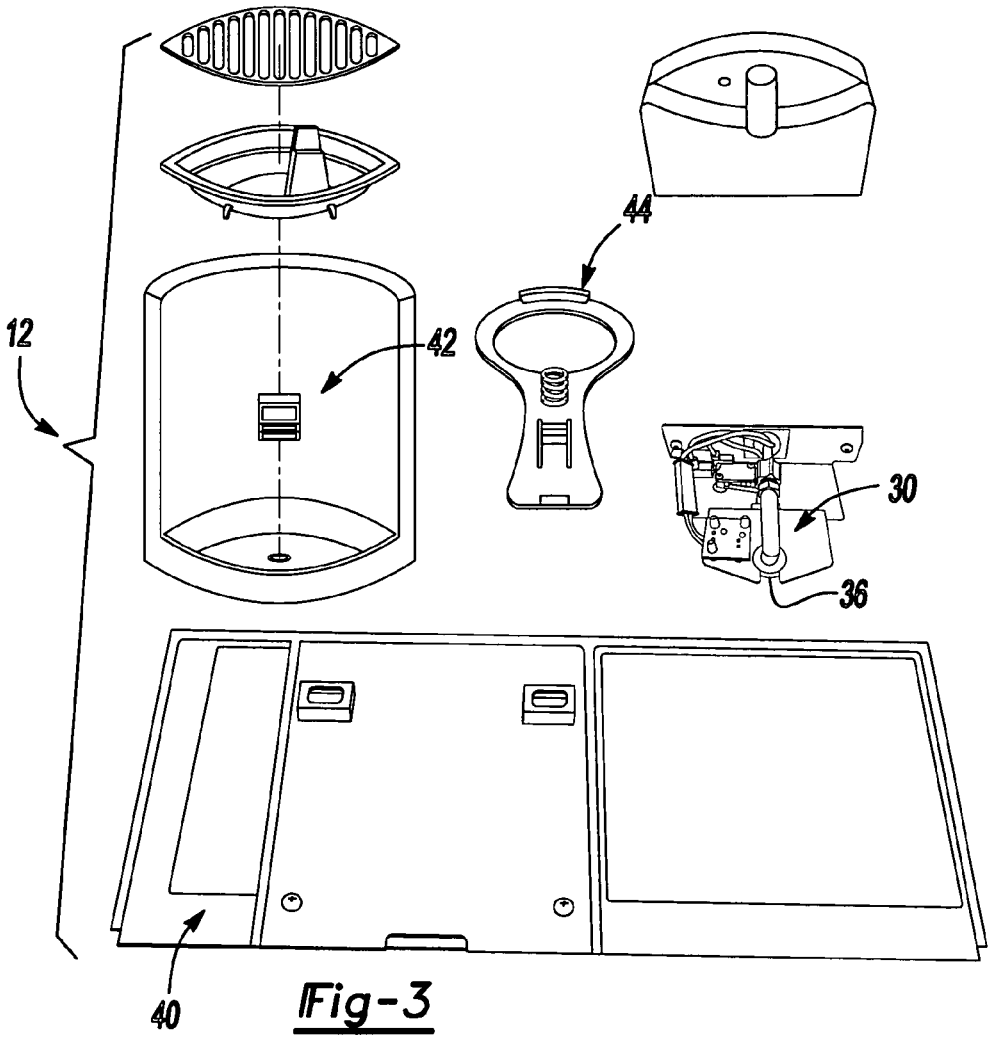
FIG. 3 is a perspective view of various components of the water dispenser shown disassembled for purposes of illustration.
Figure 4:
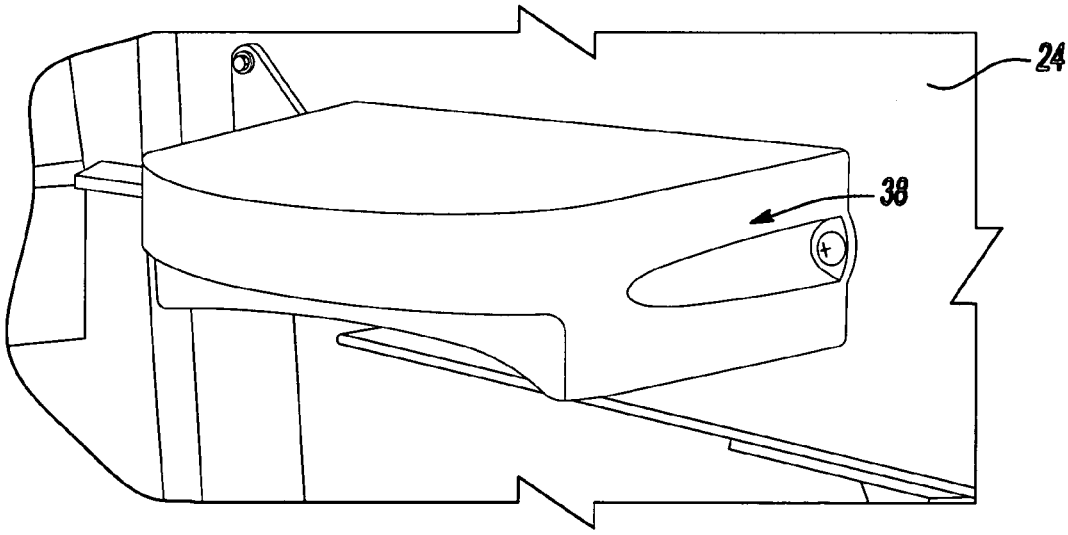
FIG. 4 is an enlarged perspective view of a portion of the water dispensing arrangement according to the present teachings.

Referring to FIGS. 1 and 3, the dispensing arrangement 12 of the present invention is illustrated to further include a panel 40 for attachment to an external side of the door 16*a*. The panel 40 provides a mounting surface for receiving a back splash 42. In the exemplary embodiment shown, the panel 40 is constructed of plastic and may be colored. Alternatively, the panel 40 may be constructed of different materials or can be constructed to moveably receive a stainless steel panel or panels of alternate colors that can be selected by the end user. Also, possible to mount other user features to panel such as pencil tray. In addition, the panel 40 can extend the full width of the door 16*a* such that insertable decorator panels (wood, acrylic, etc.) do not require additional trimming to fit around dispenser arrangement 12.

The dispensing arrangement 12 of the present invention further includes a paddle 44. The paddle 44 is pivotally attached to the back splash 42 and is operative in a substantially conventional manner to actuate the actuator 80 of the nozzle 30 upon introduction of a water glass or the like, when the doors associated with the dispensing arrangement 12 are in their closed position. The paddle 44 can be spring-biased in a position that does not actuate the nozzle 30. Alternatively, it will be appreciated by those skilled in the art that the nozzle 30 may be conventionally actuated by or in combination with a push button, photo sensor, etc. for the dispensing of chilled water. Accordingly, the panel 40, back splash 42 and paddle 44 are mounted for rotation with the door 16*a*. Significantly, none of the components of the water dispensing arrangement 12 of the present invention is positioned within either of the compartments 20 or 22 of the refrigerator 10.

Figure 5:
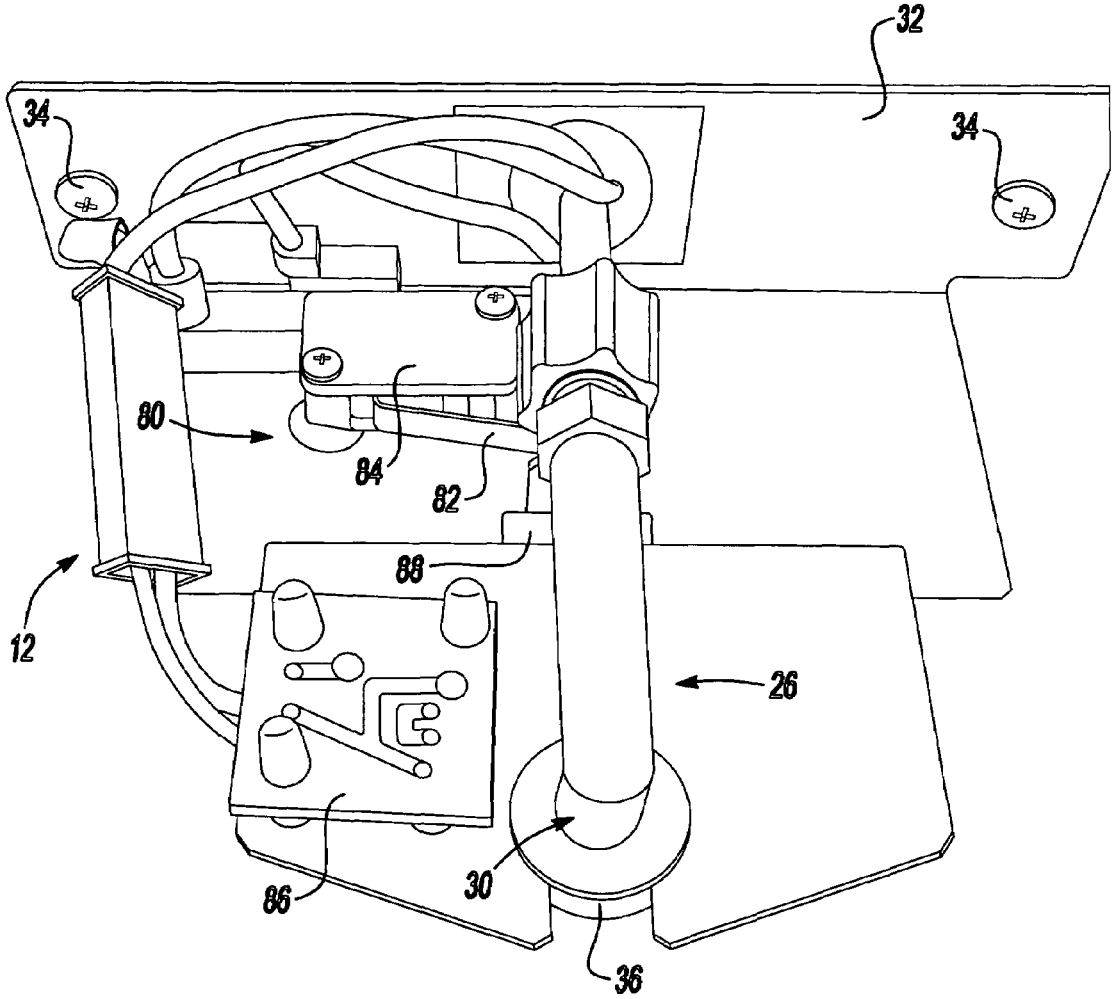
FIG. 5 is a perspective view similar to FIG. 4 shown with a cover removed for purposes of illustration.

Referring to FIG. 5, the nozzle actuator 80 can include a deflecting arm 82 actuated by a button 88 or other device coupled to the paddle 44 when the doors associated with the dispensing arrangement 12 are in their closed position. The deflecting arm 82 is coupled to a controller 84. The controller 84 can send a signal to open a water valve to let water into the nozzle 30 and can also communicate to an LED board 86 to provide lighting for the cup. LED light power limits power consumption which is important for motor vehicle applications. As important to such applications, LEDs have increase life, particularly in a vibrating environment. It will be appreciated, however, that other known actuators and lighting arrangements can be used.

Figure 6:
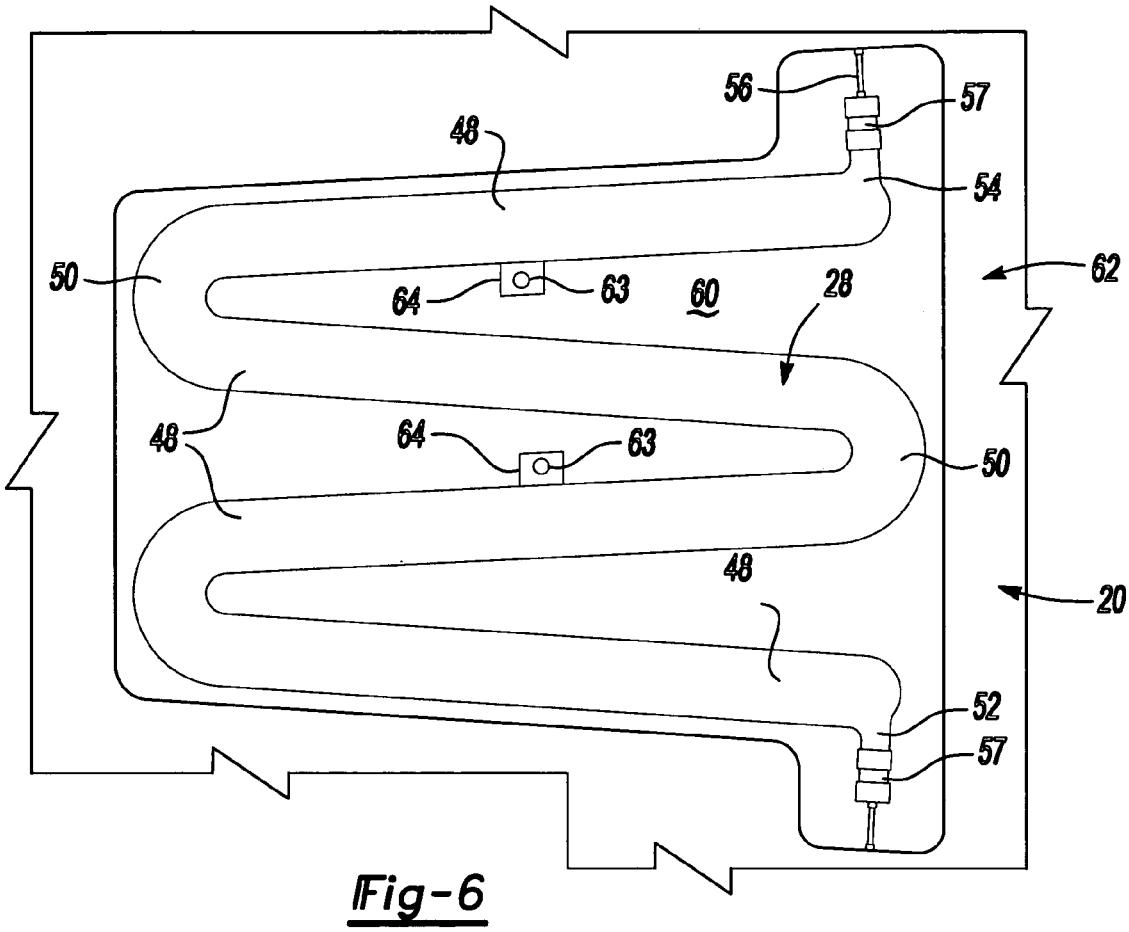
FIG. 6 is an enlarged perspective view of a portion of the refrigerator of FIGS. 1 and 2, illustrating a water reservoir with a cover for the water reservoir removed for purposes of illustration.
Figure 7:
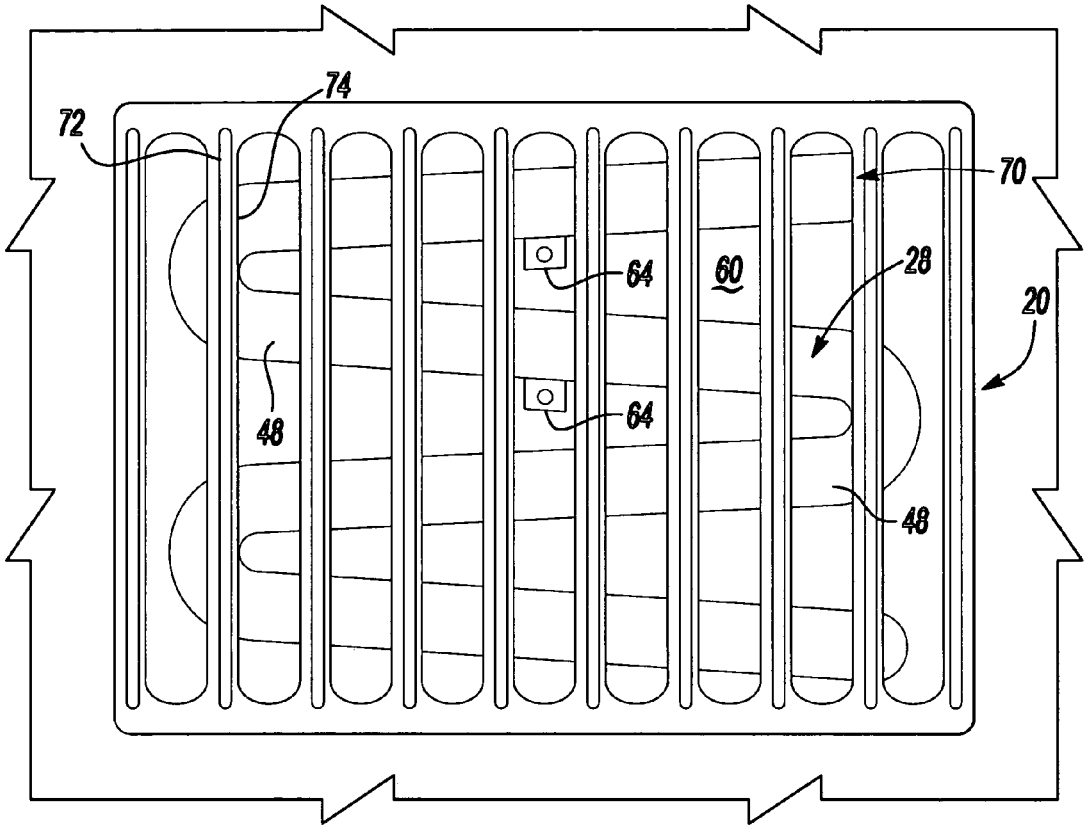
FIG. 7 is an enlarged perspective view of a portion of the refrigerator of FIGS. 1 and 2, further illustrating the water reservoir with the cover.
Figure 8:
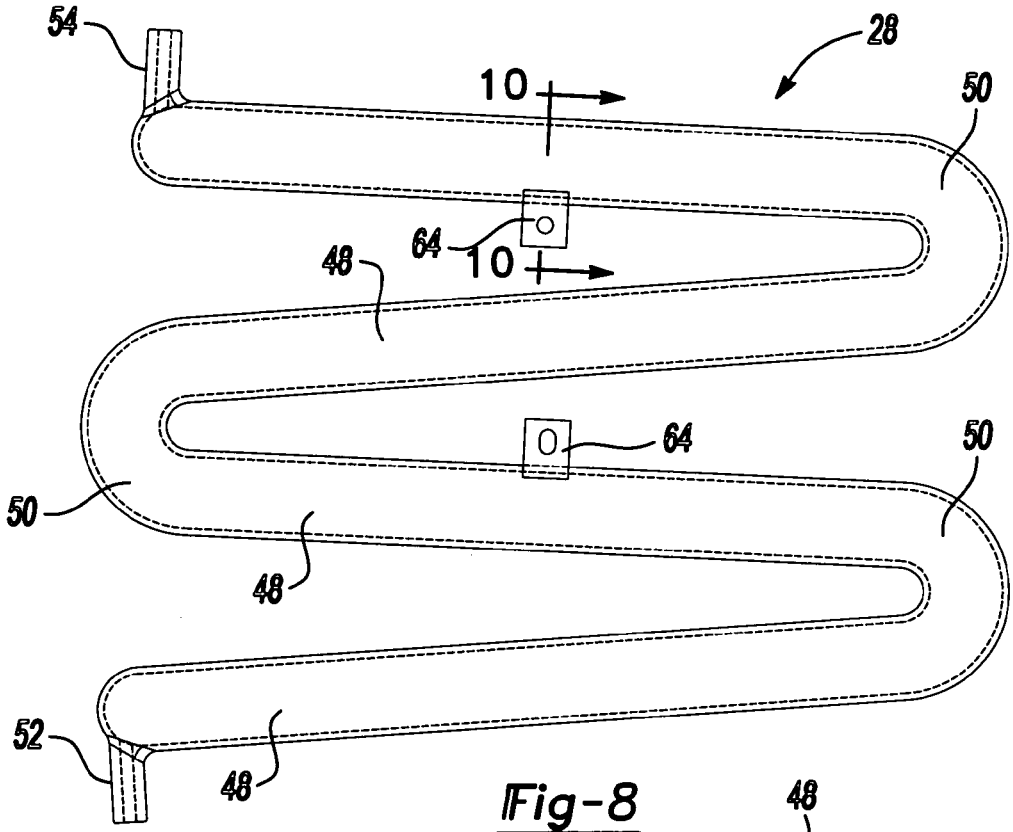
FIG. 8 is a front view of the water reservoir of the present invention shown removed from the refrigerator.
Figure 10:
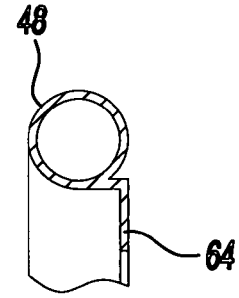
FIG. 10 is a cross-section view taken along the line 10-10 of FIG. 8.
Figure 9:
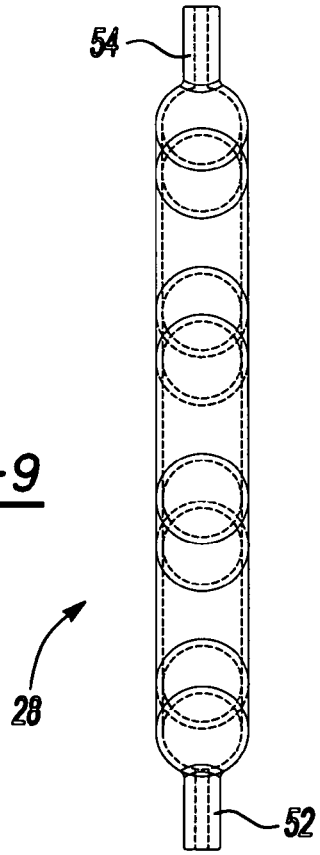
FIG. 9 is a side view of the water reservoir of FIG. 8.
Figure 11:
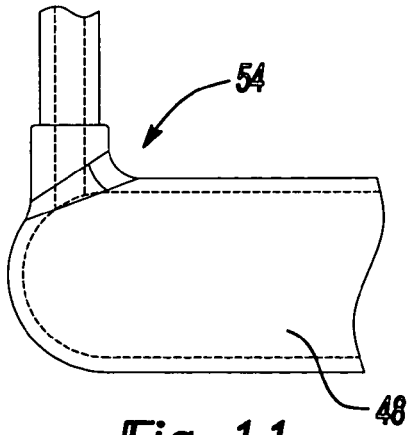
FIG. 11 is an enlarged view of a water outlet of the reservoir of FIG. 8.

The serpentine water reservoir 28 of the present invention is illustrated in FIG. 8 FIGS. 6 and 7 similarly illustrate environmental views the reservoir 28. The reservoir 28 can be unitarily molded of plastic without any junctions between portions thereof, or can be constructed from several parts that are joined together by known means.

The serpentine water reservoir 28 is illustrated to generally include a plurality of tubular legs 48. In the embodiment illustrated, the reservoir 28 includes four tubular legs 48. Those skilled in the art, however, will readily appreciate that a greater number or lesser number of legs 48 may be incorporated as a matter of design choice for particular applications. The legs 48 are each oriented at an angle relative to the horizontal. Adjacent legs 48 are connected at elbows 50.

A lower end of the serpentine reservoir 28 terminates at a water inlet 52. An upper end of the serpentine reservoir 28 terminates at a water outlet 54. The water outlet 54 is coupled to the nozzle 30 by a water line or tubing 56 (see, e.g., FIG. 2) which extends through the mullion 24. The tubing 56 is taped or otherwise secured to a lower surface of the mullion 24 prior to foaming of the mullion 24 in a conventional manner. Positioning of the tubing 56 adjacent the lower or refrigerator compartment 20 helps to prevent freezing of the tubing 56 which otherwise may occur adjacent the upper or freezer compartment 22. The water outlet 54 and water inlet 52 can be coupled to the tubing 56 using a female-to-female adapter 57, or with other known coupling methods including male-female connections, for example.

Referring to FIGS. 6 and 7, the serpentine reservoir 28 can be mounted within a cavity 60 formed into an insulated rear wall 62 of the refrigerator 10 . The cavity 60 is of the sufficient depth to allow the serpentine reservoir 28 to be installed substantially flush with an outer surface of the wall 62. Therefore, the reservoir 28 will not protrude into the useable storage space of the compartment 20. The depth of the cavity 60 should be kept at a minimum to prevent excess heat leakage into the refrigerator 10 . The vertical arrangement of the reservoir 28 allows a sufficient volume of water to be stored while minimizing the depth of the cavity 60. In one particular application, the reservoir can hold 29 ounces of water.

Referring to FIGS. 6-8 and 10 the serpentine reservoir 28 is shown to integrally include a pair of mounting portions 64. The mounting portions 64 each receive a fastener 63 for attachment of the reservoir 28 to the wall 62. Alternatively, the reservoir 28 may be secured to the wall 62 with discrete brackets and fasteners or otherwise suitably attached in many well known in the art.

Once the reservoir 28 is full and water begins to cool, the coldest water (32° F.-39° F.) will settle toward the bottom of the reservoir 28, while slightly warmer water will migrate to the top of the reservoir 28. This stratification is due to the physical fact that water density changes with temperature. Water is at a maximum density between 32° F. and 39° F. The legs 48 are angled to allow this stratification to occur. The angles of the kegs can also be selected to minimize height (or vertical space) occupied by the reservoir 28, while considering vehicle levelness. Because the serpentine reservoir 28 is filling from the bottom, the angled legs allow air to easily escape through the top outlet 54 and thereby prevent air entrapment in the reservoir 28.

In use, warmer incoming water enters the reservoir 28 through the bottom inlet 52 and immediately mixes with the coldest water to help cool the water faster. The bottom inlet 52 is configured to direct the incoming water toward an inside wall of a tubular leg, thereby creating a swirling (turbulence) effect for the incoming water. The swirling effect helps to impede warm water flow toward the top of the reservoir 28. Otherwise, water injected parallel to the leg may result in a warm water stream directed toward the top of the reservoir 28 rather than mixing with the coldest water efficiently. The warmer incoming water is forced to travel in a serpentine course toward the outlet 54. This action gives the chilled water ahead of the warmer water an opportunity to escape before the entire reservoir 28 fills with warmer water. In addition, a slight amount of thermal heat transfer takes place to help lower the temperature of the warmer water as it migrates through the reservoir 28.

The present teaching provide various measures for reducing the risk of rupture to the serpentine reservoir 28 in the event water freezes within the reservoir 28. These measures can include the incorporation of round tubular legs 48 which reduce stress compared to other geometric shapes. Additionally, these measures include securement of the reservoir 28 to the cabinet 14 at only two places (i.e., at mounting portions 64 discussed above) to allow expansion vertically and relieve stress. Furthermore, these measures can include legs 48 unitary molded, or legs 48 which are joined to each other only in an end-to-end fashion to thereby allow for expansion and stress relief. Still yet, these measures can include construction of the reservoir 28 of a low-density polyethylene (LDPE) or other known material that allows expansion and reduce stress. The wall thickness of the reservoir is selected to be sufficient to provide enough rigidity to prevent expansion under normal operating pressure. Otherwise, If the reservoir 28 expanded under normal pressure, water would continue to dispense after the water valve was closed until the pressure had been equalized.

The body of the serpentine reservoir 28 may be in physical contact with the rear cabinet wall 62. The temperature of the cabinet wall 62 is typically above freezing. The heat transfer from the cabinet wall 62 to the reservoir 28 acts to slightly raise the water temperature from a temperature that would otherwise occur without physical contact. The water, however, still remains at a chilled temperature. Under certain operating conditions, it may be desirable to introduce a small air gap between the cabinet wall 62 and the reservoir 28 to provide a slightly lower temperature of the chilled water.

Referring to FIG. 7, the chilled water dispensing arrangement 12 can further includes a decorative cover 70 for at least partially covering the serpentine reservoir 28. The cover 70 can be louvered or vented and is installed over the recessed reservoir 28 to improve aesthetics. The vents or louvers 74 allow for circulation of cooling air. In addition, the cover 70 can incorporate built-in projections 72 to prevent food items from blocking air circulation to the reservoir 28. The cover 70 may be removed for cleaning or replacement. In one particular application, the cover 70 and wall 62 can incorporate hook and loop type fastening materials (i.e. Velcro®) for attachment of the cover 70 to the wall 62. In this manner a cleaner appearance is obtained without any screws showing.

Significantly, the serpentine reservoir 28 allows for easy drainage for winterization or sanitation. While not particularly illustrated, the refrigerator 10 includes an electrically operated water inlet valve mounted outside the refrigerator 10 and below the reservoir inlet 52. The serpentine reservoir 28 will easily drain once the dispenser water line is removed from the water valve. Drainage of the reservoir 28 is facilitated by the leg angles.

Figure 12:
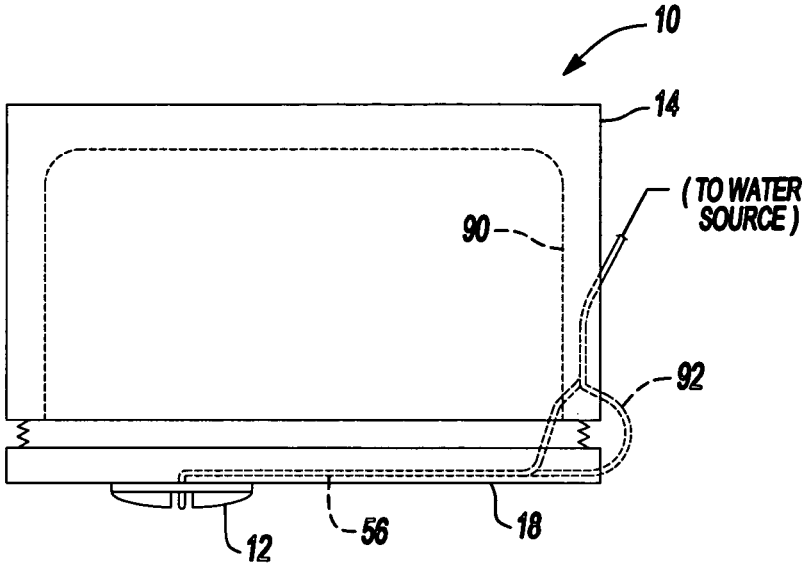
FIG. 12 is a top view of a refrigerator according to the present teachings.
Figure 13:
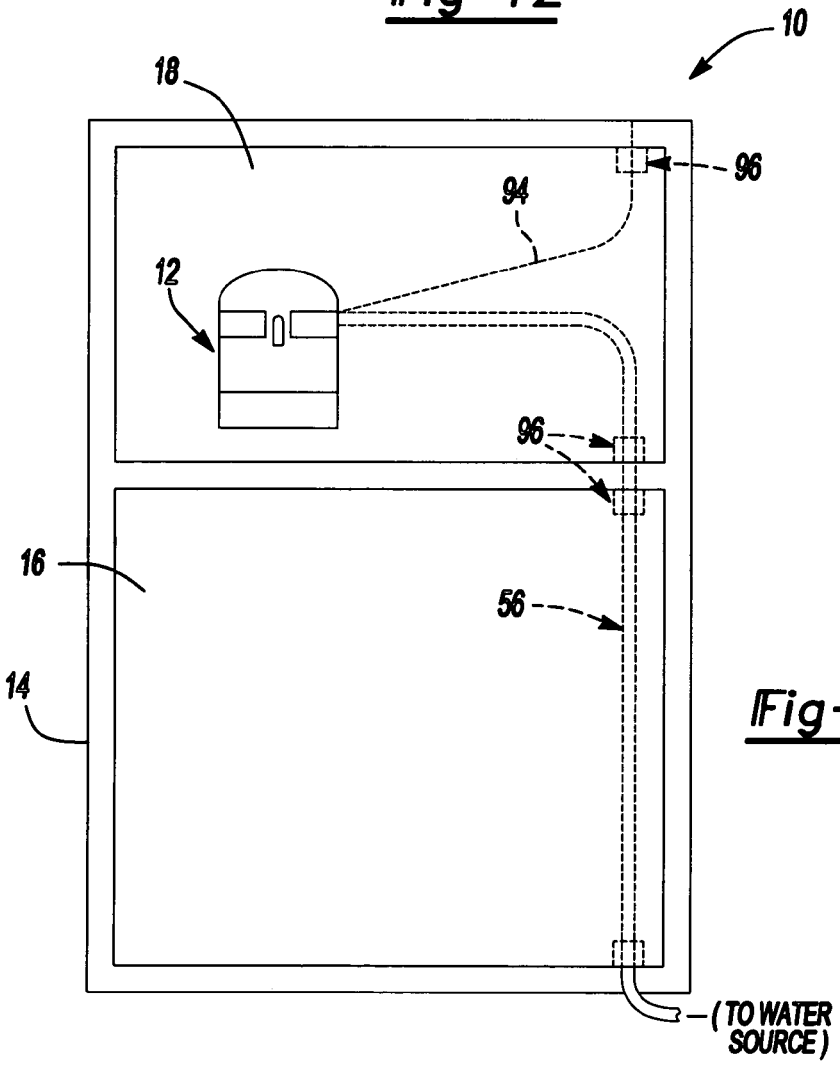
FIG. 13 is a front view of a refrigerator according to the present teachings.

Various aspects and exemplary embodiments of the present teachings are further illustrated in FIGS. 12-15. Referring to FIG. 12, according to an aspect of the present teachings, the refrigerator 10 can include a dispensing arrangement 12 mounted to a front face of the door 18. The water line or tubing 56 can be routed internally through the door 18 and a cabinet liner 90. As shown at 92, a wiring harness 94 (shown in FIG. 13) can be similarly routed. The tubing 56 and/or the wiring harness 94 may be alternatively routed through the outer surfaces of the door 18 and the cabinet 14. Referring to FIG. 13, the wiring harness 94 and the water tubing 56 can be also routed through hollow door hinges 96.

Figure 14:
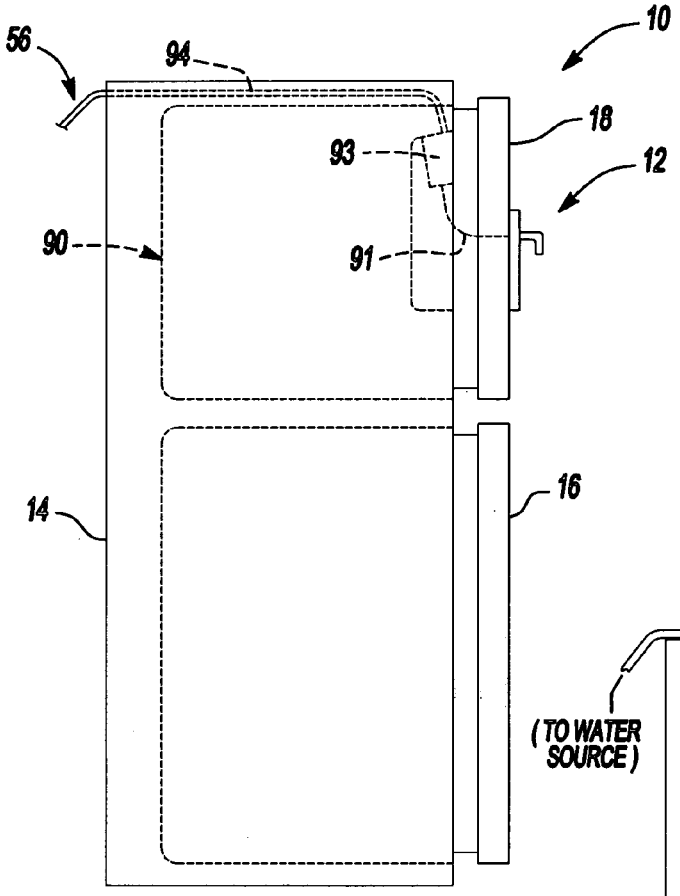
FIG. 14 is a side view of a refrigerator according to the present teachings.

Referring to FIG. 14, the water dispensing arrangement 12 can be attached to the door 18. A fill cup 93 can be positioned inside the door and in fluid communication with the tubing 56. A water connection 91 between the cabinet 14 and the door 18 permits water to be dispensed only when the door 18 is closed.

Figure 15:
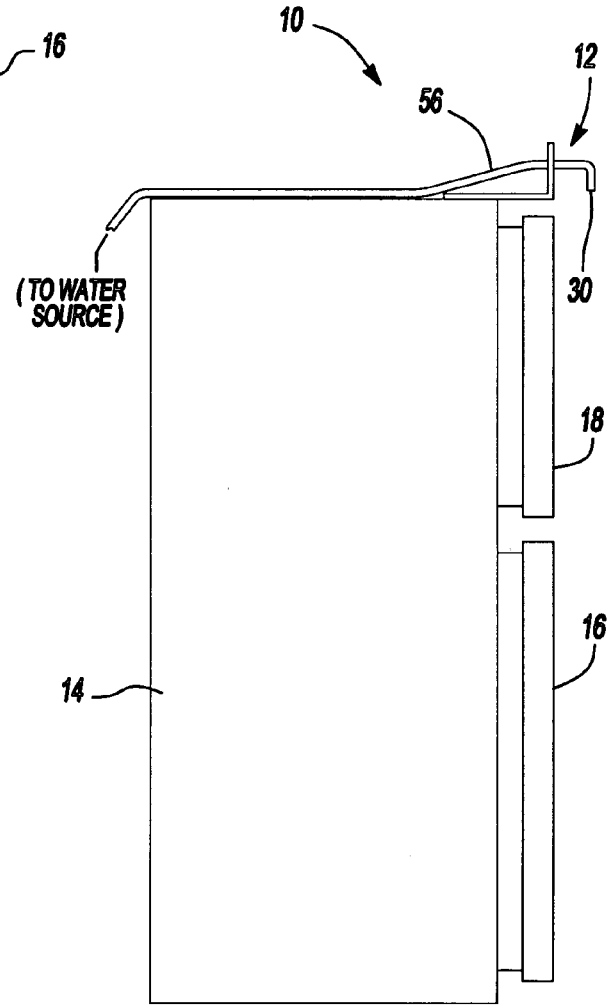
FIG. 15 is a side view of a refrigerator according to the present teachings.

Referring to FIG. 15, the water dispensing arrangement 12 can be mounted on a top surface of the cabinet 14. The dispenser nozzle 30 may be mounted in its own housing or in a control housing. The tubing 56 and wire harness 94 (not shown) may extend across the top of the cabinet 14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A refrigerator comprising:

a cabinet;

at least one door mounted to the cabinet for movement between a closed position and an open position;

a water dispenser including a nozzle mounted fixedly relative to the cabinet and independent from the at least one door, extending from the cabinet and accessible when the door is in its closed position; and a plurality of legs, each leg oriented at an angle relative to the vertical, a water inlet adjacent a lower end of the reservoir, and a water outlet adjacent an upper end of the reservoir, the water inlet oriented to direct an incoming source of water toward an inside wall of one of the legs to create a turbulent effect for the incoming water.

2. The refrigerator of claim 1, wherein the cabinet includes a plurality of external walls and a mullion extending between a pair of parallel walls of the plurality of external walls to divide storage area into multiple compartments, the nozzle extending from the mullion.

3. The refrigerator of claim 1, wherein the mullion is horizontally oriented.

4. The refrigerator of claim 1, wherein the at least one door includes a first door spaced apart from a second door, the nozzle extending from the cabinet through a space between the first door and the second door.

5. The refrigerator of claim 4, wherein the first door is positioned above the second door.

6. The refrigerator of claim 1, wherein the cabinet and the at least one door cooperate to define a storage area and further wherein the water dispenser is disposed completely outside the storage area.

7. The refrigerator of claim 1, wherein the cabinet and the at least one door cooperate to define an interior food storage area and wherein the refrigerator further includes a reservoir for storing a source of chilled water, the reservoir disposed inside the storage area and mounted to a rear wall.

8. The refrigerator of claim 7, wherein the reservoir has a serpentine shape.

9. The refrigerator of claim 7, wherein the reservoir has an inlet at a lower end and an outlet at an upper end.

10. The refrigerator of claim 1, wherein the reservoir is constructed of a low-density polyethylene.

11. The refrigerator of claim 1, wherein the reservoir is integrally constructed to include at least one mounting bracket.

12. The refrigerator of claim 1, further comprising a nozzle actuator carried by the cabinet and proximate the nozzle for controlling a flow from the nozzle.

13. The refrigerator of claim 12, further comprising a movable element carried by the at least one door and operative for controlling the nozzle actuator.

14. A refrigerator comprising:

a cabinet;

at least one door mounted to the cabinet for movement between a closed position and an open position; and a water dispensing arrangement including a dispensing portion fixedly mounted relative to the cabinet and independent from the at least one door, the dispensing arrangement extending from the cabinet and accessible when the door is in its closed position, the dispensing arrangement including a nozzle and a nozzle actuator for controlling a flow from the nozzle; and a movable element carried by the at least one door and operative for controlling the nozzle actuator.

15. The refrigerator of claim 14, wherein the water dispensing arrangement is mounted proximate a top surface of the cabinet.

* * * * *